United States Patent [19]

Fushiya et al.

[11] Patent Number: 4,503,736

[45] Date of Patent: Mar. 12, 1985

[54] BOLT TIGHTENING TOOL

[75] Inventors: Fusao Fushiya; Kazuyuki Miyamoto, both of Anjo, Japan

[73] Assignee: Makita Electric Works, Ltd., Aichi, Japan

[21] Appl. No.: 473,961

[22] Filed: Mar. 10, 1983

[30] Foreign Application Priority Data

Mar. 16, 1982 [JP] Japan ..... 57-37247[U]
May 28, 1982 [JP] Japan ..... 57-79232[U]
Jul. 14, 1982 [JP] Japan ..... 57-107172[U]

[51] Int. Cl.[3] ..... B25B 17/00
[52] U.S. Cl. ..... 81/55
[58] Field of Search ..... 81/55, 56

[56] References Cited

U.S. PATENT DOCUMENTS 3,028,777 4/1962 Essex ..... 81/55
3,162,072 12/1964 Stewart ..... 81/55
4,286,482 9/1981 Marsch et al. ..... 81/55
4,403,529 9/1983 Ikeda et al. ..... 81/56

*Primary Examiner*—James L. Jones, Jr.
*Attorney, Agent, or Firm*—Dennison, Meserole, Pollack & Scheiner

[57] ABSTRACT

Disclosed herein is a bolt tightening tool for tightening a nut onto a bolt, of the type driven by an electric motor, including an outer sleeve adapted to receive a nut for rotational drive therewith, the outer sleeve having an engaging section provided on the inner periphery thereof; an inner sleeve adapted to receive a bolt-tip formed at the extreme end of a bolt, the inner sleeve being mounted within the outer sleeve and effective to move in one axial direction, the inner sleeve having a window portion provided in and extending vertically through the upper wall portion thereof; an engaging member operatively inserted in the window portion and adapted to move in the radial direction of the inner sleeve for engagement with the engaging section of the outer sleeve; a cylindrical movable member operatively inserted in the inner sleeve for movement in the axial direction of the inner sleeve; and a spherical projection provided on a portion of the outer periphery of the cylindrical movable member and adapted to project into the window portion for moving the engaging member; whereby when the spherical projection is retracted by the cylindrical movable member pushed by the bolt-tip, the engaging member is disengaged from the engaging section of the outer sleeve, and when the spherical projection is advanced by the cylindrical movable member, the engaging member is engaged with the engaging section of the outer sleeve.

2 Claims, 13 Drawing Figures

BOLT TIGHTENING TOOL

BACKGROUND OF THE INVENTION

1. Field of the Invention

The present invention relates to a bolt tightening tool for tightening a nut onto a bolt, and more particularly to a bolt tightening tool in which an outer sleeve adapted to receive the nut and an inner sleeve adapted to receive a bolt-tip provided at the extreme end of the bolt are rotated in the directions opposite to each other to produce shearing force on the bolt-tip which in turn is used to tighten the nut onto the bolt.

2. Description of the Prior Art

In a conventional bolt tightening tool shown in FIG. 1, an inner sleeve i adapted to receive a bolt-tip projecting from the bolt end for rotational drive therewith is axially movably disposed within an outer sleeve o adapted to receive a nut for rotational drive therewith. The outer sleeve o rotates and tightens the nut, and the bolt tip inserted in the inner sleeve i is sheared through the reaction force produced during the tightening operation so as to increase the bolt tightening force. In such a construction, however, even when the inner sleeve i receives the end portion of the bolt-tip inadequately, the outer sleeve o receives the nut to rotate it, causing failure or deformation of the end portion of the inadequately received bolt-tip which disadvantageously results in reduction of the tightening force and workers' accidents.

SUMMARY OF THE INVENTION

It is an object of the present invention to provide a bolt tightening tool which ensures an adequate fitting condition for the nut and the bolt-tip during bolt tightening operation, so as to eliminate the above disadvantage associated with the prior art.

It is another object of the present invention to provide a bolt tightening tool which prevents an inadequately fitting condition for the nut and the bolt-tip during bolt tightening operation so as to positively transmit, to the bolt and the nut, the rotational torque produced when the bolt-tip is sheared.

In a bolt tightening tool according to the present invention, an inner sleeve adapted to receive a bolt-tip for rotational drive therewith is disposed within an outer sleeve adapted to receive a nut for rotational drive therewith. The inner sleeve has a window portion, and an engaging member is disposed in the window portion and adapted to move in the radial direction of the inner sleeve for engagement with the inner periphery of the outer sleeve. A cylindrical movable member is inserted in the inner sleeve and adapted to reciprocate in its axial direction. A spherical projection is fitted in a portion of the outer periphery of the cylindrical movable member, projecting into the window portion for moving the engaging member. When the spherical projection is retracted by the cylindrical movable member pushed by the bolt-tip, the engaging member is disengaged from the inner periphery of the outer sleeve, and when the spherical projection is advanced by the cylindrical movable member, the engaging member is retained on the outer sleeve.

In the second embodiment, an engaging member is disposed in the window portion provided in the inner sleeve and is adapted to move in the radial direction of the inner sleeve, and a slide member is provided in a cylindrical member fixed within the inner sleeve and is adapted to move in the axial direction. The sliding member has a projection adapted to engage and move the engaging member in the radial direction of the inner sleeve when the sliding member moves in the axial direction. With this arrangement, when the slide member is moved, the engaging member is engaged with or disengaged from the inner periphery of the outer sleeve.

In the third embodiment, a spherical trapping member is provided in the inner sleeve movably in the radial direction of the inner sleeve, and is urged by a spring against the inner periphery of the outer sleeve. When the inner sleeve is moved, the trapping member is moved axially, passing over an annular ridge provided at the inner periphery of the outer sleeve.

In the fourth embodiment, an annular engaging groove is provided at the outer periphery of the inner sleeve. A spherical trapping member is fitted in the outer sleeve movably in the radial direction of the outer sleeve, and is urged by a spring against the outer periphery of the inner sleeve. When the inner sleeve is moved, the trapping member is axially moved, passing over the engaging groove.

DETAILED DESCRIPTION OF THE INVENTION

Figure 1:
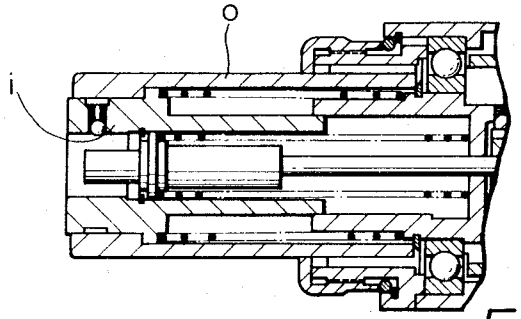
FIG. 1 (Prior Art)
FIG. 1 is a side sectional view of the essential parts of the prior art bolt tightening tool.
Figure 2:
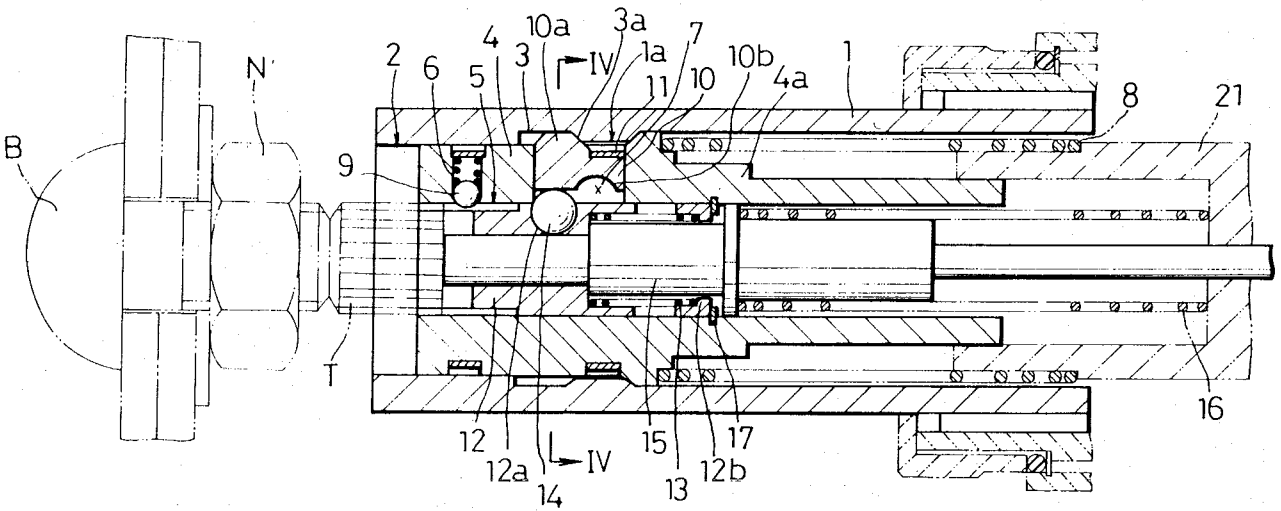
FIG. 2 is a side sectional view of the essential parts of a first embodiment of the present invention.
Figure 3:
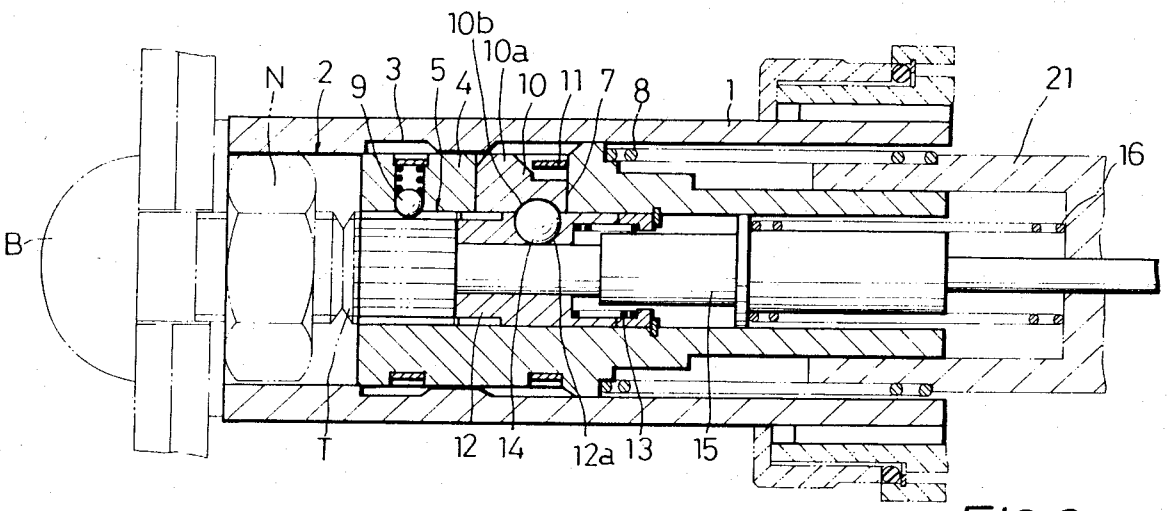
FIG. 3 is a side sectional view of the essential parts while the bolt is being tightened.
Figure 4:
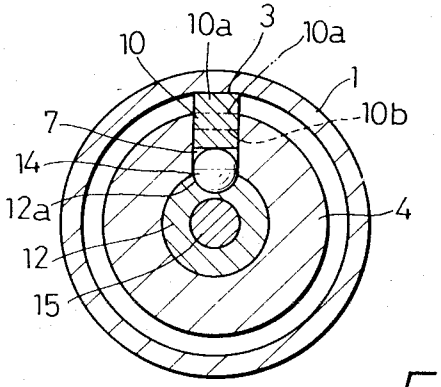
FIG. 4 is a sectional view taken along line IV—IV of FIG. 2.
Figure 5:
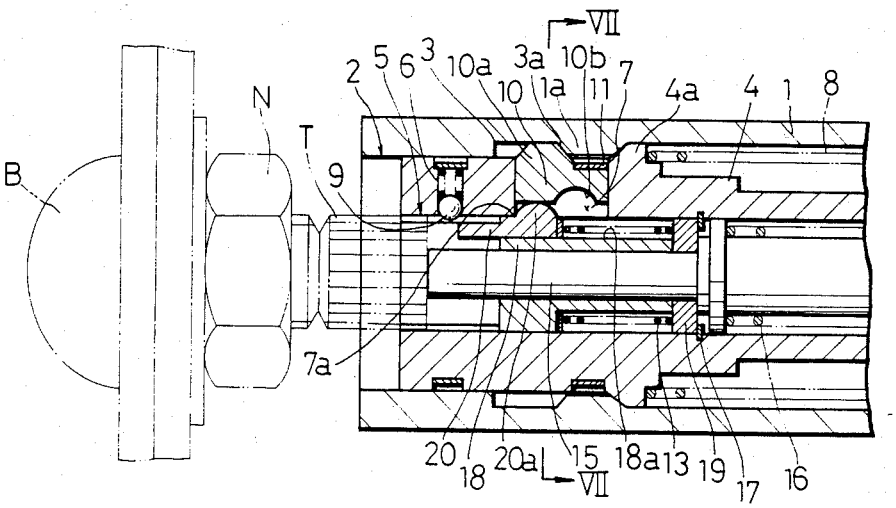
FIG. 5 is a side sectional view of the essential parts of a second embodiment of the present invention.
Figure 6:
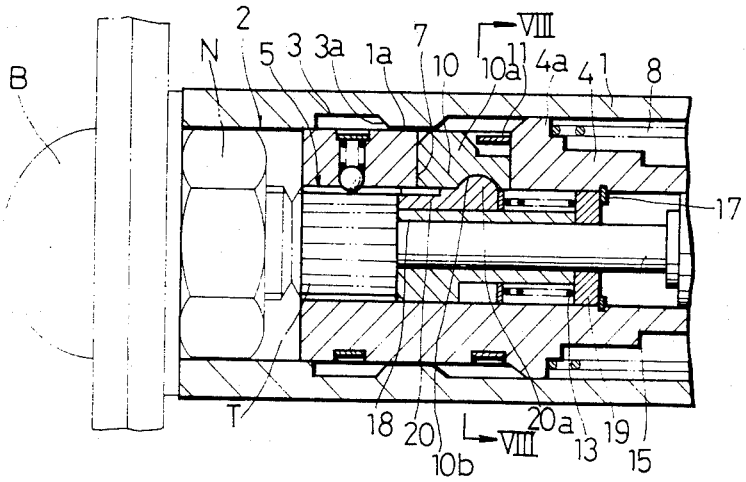
FIG. 6 is a side sectional view of the essential parts of the second embodiment while the bolt is being tightened.
Figure 7:
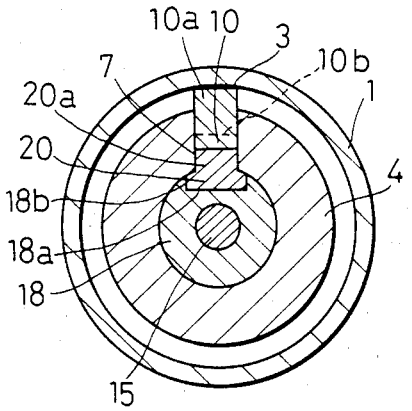
FIG. 7 is a sectional view taken along line VII—VII of FIG. 5.
Figure 8:
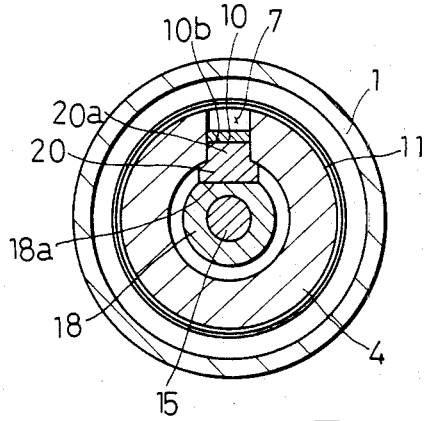
FIG. 8 is a sectional view taken along line VIII—VIII of FIG. 6.
Figure 9:
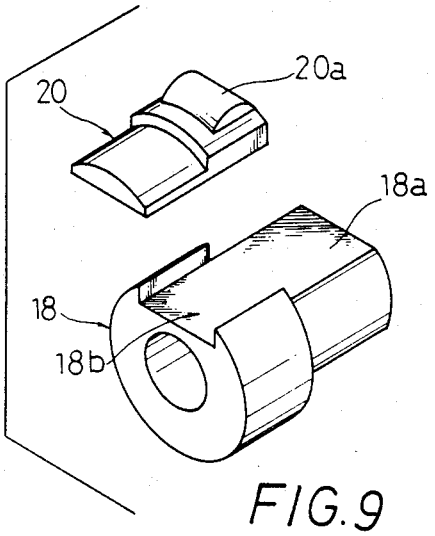
FIG. 9 is an exploded perspective view of a cylindrical guide member and a slide member.

Referring to FIGS. 1 to 4 in which the first embodiment of the present invention is shown, a substantially cylindrical outer sleeve 1 is journaled in the forward portion of a housing of a bolt tightening tool body (not shown) and is driven for rotation by an electric motor through a speed reduction mechanism (not shown). The outer sleeve 1 has at the inner periphery of the forward end thereof a polygonal, nut-receiving portion 2 adapted to receive a nut N for rotational drive therewith, and an engaging section 3 which is concaved at the back of the nut-receiving portion 2 and has a retaining surface 3*a* slantingly provided at the rear end thereof.

A substantially cylindrical inner sleeve 4 is disposed within the outer sleeve 1, being rotatable and axially reciprocating therewithin, and is driven by the electric motor through the speed reduction mechanism (not shown) for the rotation in the direction reverse to the outer sleeve 1. The inner sleeve 4 has at the inner periphery of the forward end thereof a polygonal, bolt-tip receiving portion 5 adapted to receive a bolt-tip T provided at the extreme end of the bolt B, an aperture 6 penetrating the inner sleeve at the front end portion thereof, and a window portion of rectangular configuration (as viewed in the drawing) at the back of the aperture 6 in opposing relationship with engaging section 3 of the outer sleeve 1. The inner sleeve 4 is normally urged forwardly by a spring 8 interposed between a bearing member 21 disposed at the back of the inner sleeve 4 and a flanged portion 4*a* of the inner sleeve 4. The flanged portion 4*a* contacts with a ridge 1*a* of the outer sleeve 1 to determine the most advanced position of the inner sleeve 4.

A holding member 9 is disposed in the aperture 6 of the inner sleeve 4 to hold the sheared bolt-tip T temporarily.

An engaging member 10 is disposed in the window portion 7 of the inner sleeve 4 and is movable in the radial direction of the inner sleeve 4. The engaging member 10 has a pawl portion 10*a* which is projected into and retracted from the window portion 7 through the radial movement of the engaging member 10 to be engaged with and disengaged from the engaging portion 3 of the outer sleeve 1. A recess 10*b* of substantially semi-circular in vertical section is provided at the rear end portion of the undersurface (as viewed in the drawing) of the engaging member 10. When it is moved upwardly (as viewed in the drawing), the engaging member 10 is restricted for its further movement by a ring 11 provided around the inner sleeve 4.

A substantially cylindrical movable member 12 is axially movably disposed within the inner sleeve 4 and urged by a spring 13 to be locked within the inner sleeve 4 between a spring-bearing shoulder 12*b* received by a locking pin 17 which in turn is fitted in the inner sleeve 4 at the back of the movable member 12 and the rear end corner of the inner periphery of the bolt-tip receiving portion 5. The movable member 12 has on the upper side thereof (as viewed in the drawing) a semi-spherical fitting recess 12*a*, and a spherical projection 14 is fitted in the fitting recess 12*a* and adapted to axially move together with the recess 12*a* to move the engaging member 10 in the radial direction of the inner sleeve 4. The contact of the spherical projection 14 with the front end of the window portion 7 determines the most advanced position of the movable member 12. When the inner sleeve 4 is advanced, the engaging member 10 is pushed into the engaging section 3 by the spherical projection 14 carried by the movable member 12 which is at its most advanced position, causing the pawl portion 10*a* of the engaging member 10 to engage with the engaging section 3 of the outer sleeve 1 to restrict the inner sleeve 4, and then when the movable member 12 is pushed backwardly against the spring 13, the spherical projection 14 is engaged with the recess 10*b* of the engaging member 10, causing the pawl portion 10*a* of the engaging member 10 to be retracted within the window portion 7. Now, retraction of the inner sleeve 4 is allowed through disengagement of the inner sleeve 4 from the outer sleeve 1.

The spherical projection 14 which is fitted at the lower portion thereof (as viewed in the drawing) in the fitting recess 12*a* of the movable member 12 and projected at the upper portion thereof into the window portion 7 allows relative movement of the inner sleeve 4 and the movable member 12 in the axial direction but restricts their relative movement in the circumferencial direction.

A tip-pushing rod 15 extends through the movable member 12 and axially reciprocates to push the sheared bolt-tip T out of the inner sleeve 4. The tip-pushing rod 15 is normally urged forwardly by the spring 16 and retracted when it is pushed by the bolt-tip not yet sheared.

The overall operation is as follows. Before the tightening operation of the bolt B is started, the inner sleeve 4 is held at its most advanced position, and the pawl portion 10*a* of the engaging member 10 pushed by the spherical projection 14 is engaged with the engaging section 3 of the outer sleeve 1 to restrict the retraction of the inner sleeve 4. (See FIG. 2.)

When the inner sleeve 4 is not allowed to retract due to the inadequate or null fitting condition of the bolt-tip T into the bolt-tip receiving portion 5 of the inner sleeve 4, the nut N is not received by the nut-receiving portion 2 and consequently bolt tightening operation may not be accomplished.

On the contrary when the movable member 12 is pushed by the bolt-tip T to be retracted until the spherical projection 14 is fitted in the recess 10*b* of the engaging member 10, the engaging member 10 is moved in the radial direction of the inner sleeve 4 to disengage the pawl portion 10*a* from the engaging section 3 and consequently to allow retraction of the inner sleeve 4. Now, the inner sleeve 4 is retracted within the outer sleeve 1 until the bolt-tip T is received completely by the bolt-tip receiving portion 5 and the nut N is received by the nut-receiving portion 2 of the outer sleeve 1.

As the outer sleeve 1 and the inner sleeve 4 are rotated in their respective directions, receiving the nut N and the bolt-tip T therewithin respectively, the rotational torque produced when the bolt-tip T is sheared is adequately transmitted to the bolt B and the nut N so as to tighten the nut N onto the bolt B. (See FIG. 3.)

Thus, when there is inadequate fitting of the extreme end of the bolt-tip T in the inner sleeve 4, the fitting of the nut receiving portion 2 into the nut N is positively checked to prevent inadequate tightening of the nut N onto the bolt B before the tightening operation is started.

When, after the bolt B being tightened, the sheared bolt-tip T is pushed out of the inner sleeve 4 by the tip-pushing rod 15, and the inner sleeve 4 is released from the backwardly pushing force applied thereto, the inner sleeve 4 is automatically restored to its forward position, and the spherical projection 14 is disengaged from the recess 10*b* of the engaging member 10, pushing up the engaging member 10 toward the engaging section 3 to restrict the retraction of the inner sleeve 4.

As, in this embodiment, the inner sleeve 4 is engaged with or disengaged from the outer sleeve 1 through movement of the engaging member 10 in the radial direction of the inner sleeve 4 caused by a spherical projection 14 which reciprocates in the axial direction of the inner sleeve 4, the engagement and disengagement are reliably and smoothly carried out. Furthermore, as the engaging member 10 is retained by the surface contact of the rear end surface of the pawl portion 10*a* of the engaging member 10 with the retaining surface 3*a* of the engaging section 3, abrasion of the retaining surface 3*a* caused by repeated engaging and disengaging operations and reduction in reliability of the engaging and disengaging operation caused as the time passes are advantageously eliminated to increase the durability of the engaging area.

Referring to FIGS. 5 to 9, there is shown the second embodiment of the present invention, in which a cylindrical guide member takes the place of the movable member in the first embodiment and a slide member is disposed on the sliding surface on the cylindrical guide member, and like reference numerals designate like or corresponding parts throughout the drawings and the explanation for them will be abbreviated.

Numeral 18 designates a substantially stepped cylindrical guide member disposed in the inner sleeve 4 and urged by a spring 13 to be locked within the inner sleeve 4 between a spring-bearing member 19 fitted in the inner sleeve 4 at the back of the guide member 18 and the rear end corner of the inner periphery of the bolt-tip receiving portion 5. The guide member 18 has a stepped front portion. A horizontal slide surface 18*a* axially extends along the uppermost side of the guide member 18 (as viewed in the drawing), and forms the bottom of a guide groove 18*b* axially provided at the stepped front portion.

A slide member 20 is disposed within the inner sleeve 4 and slidably moves in the axial direction along the guide member 18 through the guide groove 18*b*. The guide member 20 has at the rear end thereof a projection 20*a* projecting upwardly (as viewed in the drawings) into the window portion 7 and axially movable in the window portion 7. The projection 20*a* is a substantially semi-cylindrical member of semi-circular configuration in cross section which can be fitted in a recess 10*b* of the engaging member 10. The slide member 20 is normally urged forwardly by the spring 13 provided between the spring-bearing member 19 and the slide member 20 in such a way that the end protion of the slide member 20 will project from the front end of the guide member 18, causing the projection 20*a* of the slide member 20 to contact with the front lower edge 7*a* of the window portion or the rearmost corner of the bolt-tip receiving portion 5 to determine the most advanced position of the slide member 20. When the inner sleeve 4 is advanced and the slide member 20 is moved forwardly, the engaging member 10 is pushed upwardly by the projection 20*a* of the slide member 20 to be moved in the radial direction of the inner sleeve 4, causing the pawl portion 10*a* of the engaging member 10 to be engaged with the engaging section 3 of the outer sleeve 1 to restrict the retraction of the inner sleeve 4. When, in this condition, the slide member 20 is pushed backwardly against the spring 13, the projection 20*a* is engaged with the recess 10*b* of the engaging member 10, causing the pawl portion 10*a* to be retracted into the window portion 7. Now, retraction of the inner sleeve 4 is allowed through disengagement of the inner sleeve 4 from the outer sleeve 1.

As the slide member 20 is fitted at the lower end (as viewed in the drawing) in the guide groove 18*b* of the guide member 18, with the projection 20*a* projecting into the window portion 7, the relative movment of the inner sleeve 4 and the guide member 18 in the axial direction is allowed, but their relative movement in the circumferential direction is restricted.

The tip-pushing rod 15 extends through the guide member 18 and axially reciprocates to push the sheared bolt-tip T forwardly out of the inner sleeve 4. The tip-pushing rod 15 is normally urged forwardly by the spring 16, and is retracted when it is pushed by the bolt-tip T not yet sheared.

The overall operation of the tool thus constructed is as follows. Before the tightening operation of the bolt B is started, the inner sleeve 4 and the slide member 20 is held at their most advanced positions, and the pawl portion 10*a* of the engaging member 10 pushed upwardly by the projection 20*a* of the slide member 20 is engaged with the engaging section 3 of the outer sleeve 1 to restrict the retraction of the inner sleeve. (See FIG. 5.)

When the inner sleeve 4 is not allowed to retract due to the inadequate or null fitting condition of the bolt-tip T into the bolt-tip receiving portion 5 of the inner sleeve 4, the nut N is not received by the nut-receiving portion 2, and consequently bolt tightening operation may not be accomplished.

On the contrary, when the slide member 20 is pushed by the bolt-tip T to be retracted until the projection 20*a* is fitted in the recess 10*b* of the engaging member 10, the engaging member 10 is moved in the radial direction of the inner sleeve 4 to disengage the pawl portion 10*a* from the engaging section 3 and consequently to allow retraction of the inner sleeve 4. Now, the inner sleeve 4 is retracted within the outer sleeve 1 through the slide member 20 and the engaging member 10 until the bolt-tip T is completely received by the bolt-tip receiving portion 5 and the nut N is received by the nut-receiving portion 2 of the outer sleeve 1. (See FIG. 6.)

As the outer sleeve 1 and the inner sleeve 4 are rotated in their respective directions, receiving the nut N and the bolt-tip T therewithin respectively, the rotational torque produced when the bolt-tip T is sheared is adequately transmitted to the bolt B and the nut N so as to tightening the nut N onto the bolt B.

Thus, when there is inadequate fitting of a portion of the bolt-tip T in the bolt-tip receiving portion 5, the fitting of the nut-receiving portion 2 into the nut N is positively checked to prevent inadequate tightening of the nut N onto the bolt B before the tightening operation is started.

When, after the bolt B being tightened, the sheared botl-tip T is pushed out of the inner sleeve 4 by the tip-pushing rod 15, and the inner sleeve 4 is released from the backwardly pushing force applied thereto, the slide member 20 and the inner sleeve 4 are automatically restored to their forward positions, and the projection 20*a* is disengaged from the recess 10*b* of the engaging member 10, pushing the engaging member 10 upwardly to restrict the retraction of the inner sleeve 4.

As, in this embodiment, the reciprocating movement of the slide member 20 in the axial direction of the inner sleeve 4 is converted into the movement of the engaging member 10 in the radial direction of the inner sleeve 4 to engage the inner sleeve 4 with or disengage it from the inner periphery of the outer sleeve 1 through the engaging member 10, the engagement and disengagement are reliably and smoothly carried out. Furthermore, as the inner sleeve 4 is retained through the pawl portion 10*a* of the engaging member 10 and the retaining surface 3*a* of the outer sleeve 1 which bears the surface pressure of the engaging member 10, abrasion of the retaining surface 3*a* caused by repeated engaging and disengaging operations and reduction in reliability of the engaging and disengaging operations caused as the time passes are advantageously eliminated.

Figure 10:
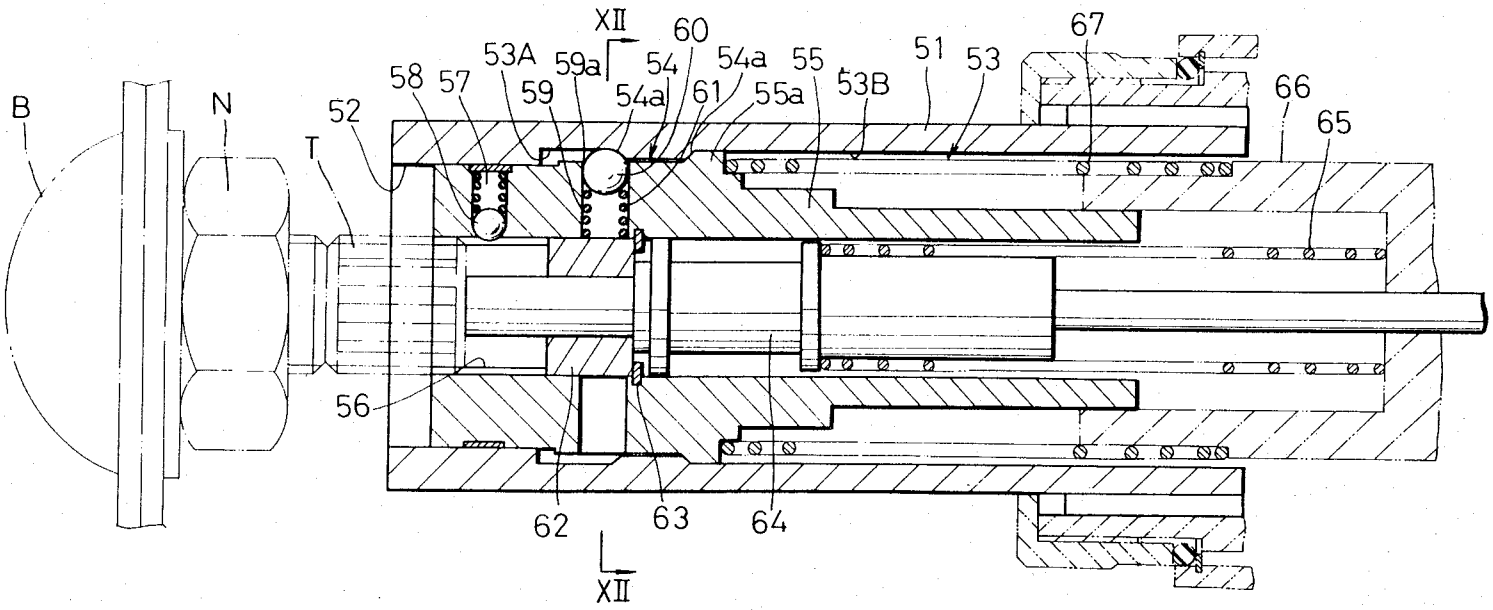
FIG. 10 is a side sectional view of the essential parts of a third embodiment of the present invention.
Figure 11:
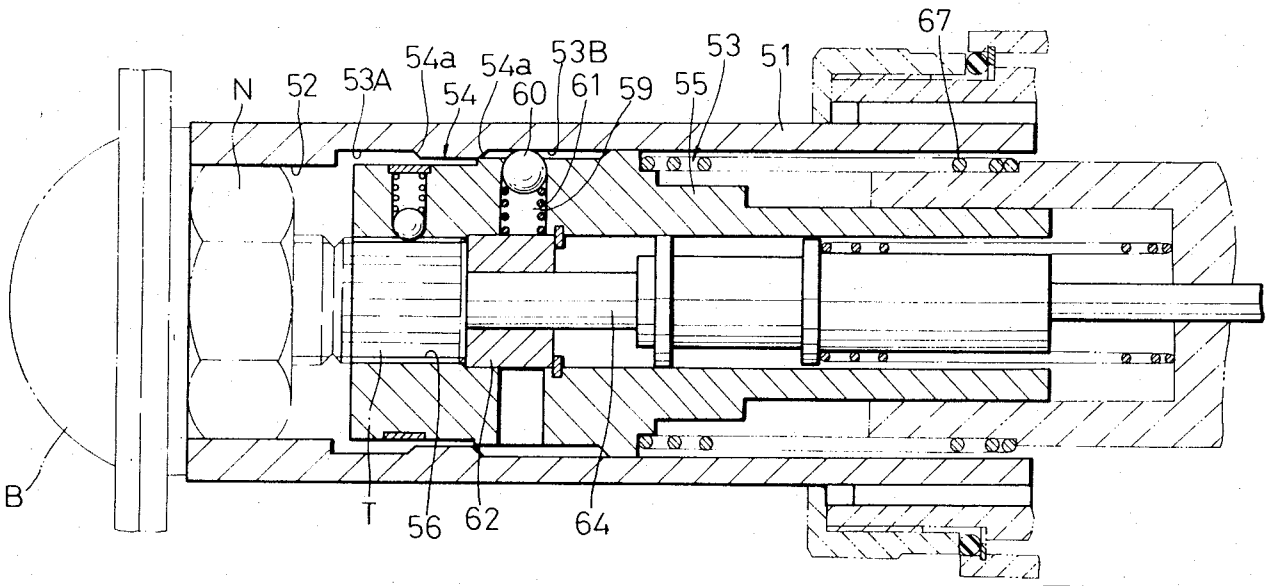
FIG. 11 is a side sectional view of the essential parts of the third embodiment while the bolt is being tightened.
Figure 12:
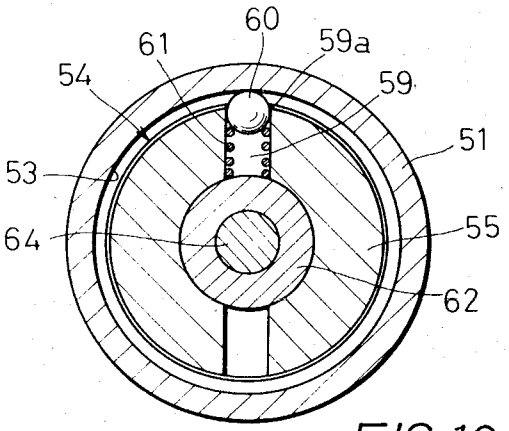
FIG. 12 is a sectional view taken along line XII—XII of FIG. 10.

Referring now to FIGS. 10 to 12, in which the third embodiment is shown, a substantially cylindrical outer sleeve 51 is journaled in the forward portion of a housing of a bolt tightening tool body (not shown). The outer sleeve 51 is driven for rotation by an electric motor through a speed reduction mechanism (not shown), and has at the inner periphery of the forward end thereof a polygonal, nut-receiving portion 52 adapted to receive a nut N for rotational drive therewith and an engaging section 53 concaved at the back of the nut-receiving portion 52. The engaging section 53 has a front engaging section 53A and a rear engaging section 53B which are separated from each other by an annular ridge 54 circumferentially provided. The ridge 54 has sliding surfaces 54 slantingly provided at the front and rear ends thereof.

A substantially cylindrical inner sleeve 55 is disposed within the outer sleeve 51, being rotatable and axially reciprocating therewithin, and is driven by the electric motor through the speed reduction mechanism (not shown) for the rotation in the direction reverse to the outer sleeve 51. The inner sleeve 55 has at the inner periphery of the forward end thereof a polygonal bolt-tip receiving portion 56 adapted to receive a bolt-tip T provided at the extreme end of the bolt B. The inner sleeve 55 is normally urged forwardly by a spring 67 interposed between a bearing member 66 disposed at the back of the inner sleeve 55 and a flanged portion 55*a* of the inner sleeve 55. The flanged portion 55*a* contacts with the annular ridge 54 of the outer sleeve 51 to determine the most advanced position of the inner sleeve 55.

An aperture 57 penetrates the inner sleeve 55 at the front end thereof and a spherical holding member 58 is disposed in the aperture 57 to hold the sheared bolt-tip T temporarily.

The inner sleeve 55 has a window portion 59 cut at the front portion thereof in opposing relationship with the front engaging section 53A of the outer sleeve 51. The outside end of the window portion 59 has a reduced opening diameter and a restricting edge 59*a* is slightly projected circumferentially.

Numeral 60 designates a spherical trapping member fitted in the window portion 59 and reciprocating in the radial direction of the inner sleeve 55. The trapping member 60 is normally urged outwardly by a spring 61 provided in the window portion 59, and a part of the trapping member 60 is projected from the restricting edge 59*a* to be pressed against the engaging section 53 of the outer sleeve 51.

When the inner sleeve 55 is pushed backwardly by the bolt-tip T, the trapping member 60 which has been engaged with the front engaging section 53A is moved over the annular ridge 54 to the rear engaging section 53B. When the inner sleeve 55 which has been retracted to the rear engaging section 53B is released from the backwardly pushing force applied thereto, the inner sleeve 55 is automatically restored forwardly through the biasing force of the spring 67, and the trapping member 60 is moved from the rear engaging section 53B across the annular ridge 54 to the front engaging section 53A.

A cylindrical supporting member 62 is disposed in the inner sleeve 55 to support the inner edge of the spring 61 and axially movable together with the inner sleeve 55. A locking ring 63 is fitted in the inner periphery of the inner sleeve 55 at the back of the supporting member 62. The supporting member 62 is, being tightly held between the locking ring 63 and the rear end corner of the inner periphery of the bolt-tip receiving portion 56, locked within the inner sleeve 55, and the inner sleeve 55 is retracted through the supporting member 62 when the bolt-tip T of the bolt B is received by the bolt-tip receiving portion 56.

Numeral 64 designates a tip-pushing rod extending through the supporting member 62 and axially reciprocating to push the sheared bolt-tip T forwardly out of the inner sleeve 55. The tip-pushing rod 64 is normally urged forwardly by a spring 65 and is retracted when it is pushed by the bolt-tip T not yet sheared.

Now, the overall operation of the tool thus constructed is as follows. Before the tightening operation of the bolt B is started, the inner sleeve 55 is held at its most advanced position, allowing the trapping member 60 to be engaged with the front engaging section 53A. When in this condition the bolt-tip T is not completely received by the bolt-tip receiving portion 56, the nut N is not received by the nut-receiving portion 52 of the outer sleeve 51, and consequently bolt tightening operation may not be accomplished. (See FIG. 10.)

When the bolt-tip T is inserted into the bolt-tip receiving portion 56 to push backwardly the inner sleeve 55 through the supporting member 62, the trapping member 60 is downwardly retracted (as viewed in the drawing) against the spring 61, frictionally sliding along the sliding surface 54*a* of the annular ridge 54 and rolling along the annular ridge 54 into the rear engaging section 53B. Now, the inner sleeve 55 is retracted within the outer sleeve 51 until the bolt-tip T is completely received by the bolt-tip receiving portion 56 of the inner sleeve 55 and the nut N is received by the nut receiving portion 52 of the outer sleeve 51. (See FIG. 11.)

As the trapping member 60 moves between the front and rear engaging sections 53A and 53B when the bolt-tip T is inserted into the inner sleeve 55, change in pushing resistance caused before and after the trapping member 60 moves across the annular ridge 54 is perceived to assure the readiness for starting the bolt tightening operation, and complete engagement of the nut N and the bolt-tip T with the nut-receiving portion 52 and the bolt-tip receiving portion 56 respectively, is achieved for starting the bolt tightening operation. The rotational torque produced when the bolt-tip T is sheared is adequately transmitted to the bolt B and the nut N for tightening the nut N onto the bolt B.

When a portion of the bolt-tip T inadequately or more precisely not received by the bolt-tip receiving portion 56 and the nut N received inadequately by the nut-receiving portion 52 are rotated for tightening the bolt B, reduction in bolt-tightening force and failure of the bolt-tip T will be caused. These disadvantages and dangers are, however, prevented before the tightening operation is started, to ensure a complete tightening operation for the bolt B and the nut N.

Figure 13:
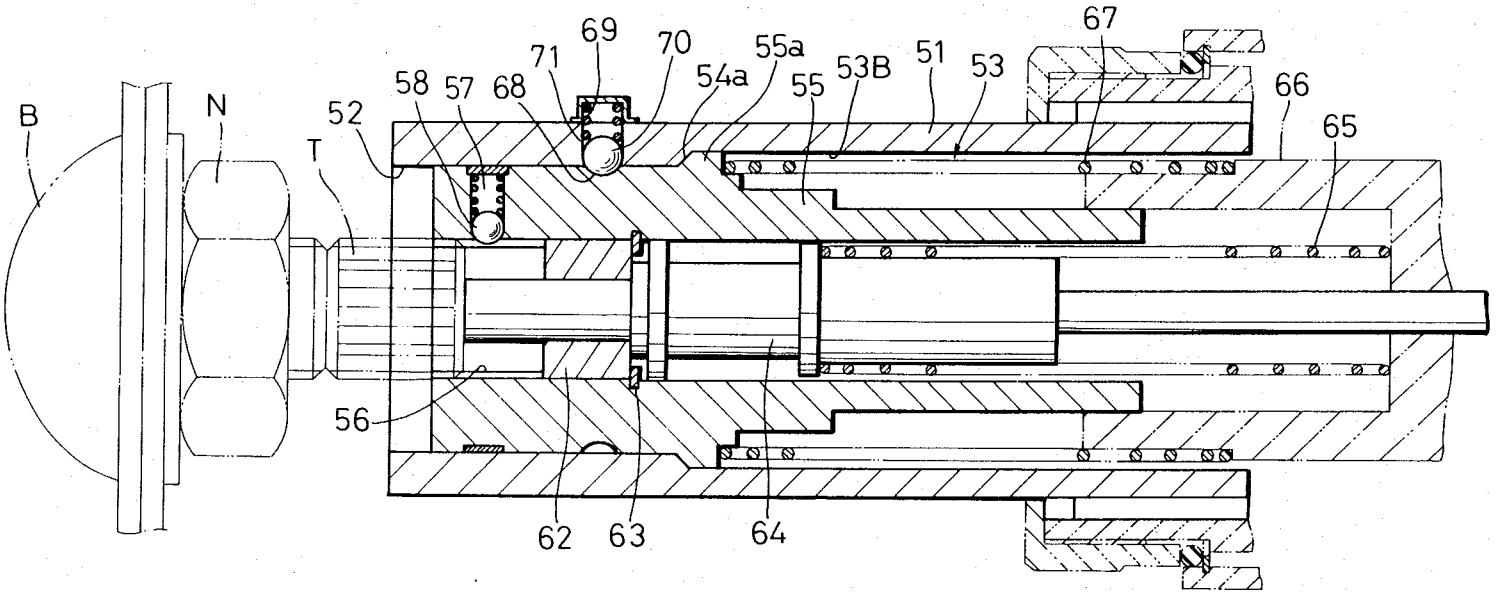
FIG. 13 is a side sectional view of the essential parts of a fourth embodiment of the present invention.

Referring to FIG. 13 in which the fourth embodiment is shown, an annular engaging groove 68 is provided at the outer periphery of the inner sleeve 55, and a spherical trapping member 70 is radially movably disposed in an aperture penetrating the outer sleeve 51, and urged by a spring 69 against the outer periphery of the inner sleeve 55. When the inner sleeve 55 moves, the trapping member 70 is axially moved over the engaging groove 68.

The overall operation of the fourth embodiment is almost the same as that of the third embodiment.

While the invention has been described with reference to a preferred embodiment thereof, it is to be understood that modifications or variations may be easily made without departing from the scope of the present invention which is defined by the appended claims.

What is claimed is:

1. A bolt tightening tool for tightening a nut onto a bolt, of the type driven by an electric motor, comprising:

an outer sleeve adapted to receive a nut for rotational drive therewith, said outer sleeve having an engaging section provided on the inner periphery thereof;

an inner sleeve adapted to receive a bolt-tip formed at the extreme end of a bolt, said inner sleeve being mounted within said outer sleeve and effective to move axially therein, said inner sleeve having a window portion provided in and extending radially therethrough for selective alignment with said engaging section;

an engaging member in said window portion and mounted for radial movement therein relative to said inner sleeve, said engaging member having a pawl portion formed on the radial outer surface thereof for engagement with said engaging section of said outer sleeve upon radial outward movement of said engaging member and a substantially semi-cylindrical recess portion formed on the radial inner surface thereof;

a cylindrical movable member in said inner sleeve mounted for movement in the axial direction of said inner sleeve, said cylindrical movable member having a concave recess formed on the outer periphery thereof and generally aligned with said window portion; and a spherical body received in said concave recess of said cylindrical member and axially movable with said cylindrical member and along said window portion, said spherical body projecting into said window portion for engagement with and radial movement of said engaging member in response to axial movement of said spherical body;

whereby when said spherical body is axially retracted with said cylindrical movable member pushed by a bolt-tip, the other portion of said spherical body is received in said semi-cylindrical recess portion of said engaging member, allowing radial inward movement of said engaging member and disengagement of the pawl portion of said engaging member from said engaging section of said outer sleeve, and when said spherical body is axially advanced with said cylindrical movable member, said spherical body moves out of the semi-cylindrical recess portion and said engaging member is pushed radially outward to engage said engaging section of said outer sleeve.

2. A bolt tightening tool for tightening a nut onto a bolt, of the type driven by an electric motor, comprising:

an outer sleeve adapted to receive a nut for rotational drive therewith, said outer sleeve having an engaging section provided on the inner periphery thereof;

an inner sleeve adapted to receive a bolt-tip formed at the extreme end of a bolt, said inner sleeve being mounted within said outer sleeve and effective to move axially therein, said inner sleeve having a window portion provided in and extending radially therethrough for selective alignment with said engaging section;

an engaging member in said window portion and mounted for radial movement therein relative to said inner sleeve, said engaging member having a pawl portion formed on the radial outer surface thereof for engagement with said engaging section of said outer sleeve upon radial outward movement of said engaging member, and a substantially semi-cylindrical recess portion formed on the radial inner surface thereof;

a guide member mounted within said inner sleeve; and a slide member slidably mounted on said guide member and movable in the axial direction of said inner sleeve, said slide member having a semi-cylindrical projection projecting into said window portion for engagement with and radial movement of said engaging member;

whereby when said semi-cylindrical projection of said slide member is axially retracted with said guide member pushed by a bolt-tip, said semi-cylindrical projection is received in said semi-cylindrical recess portion of said engaging member, allowing radial inward movement of said engaging member and disengagement of said pawl portion of said engaging member from said engaging section of said outer sleeve, and when said semi-cylindrical projection is axially advanced, said semi-cylindrical projection is disengaged from said semi-cylindrical recess portion of said engaging member and pushes said engaging member radially outward to engage said engaging section of said outer sleeve.

* * * * *